United States Patent [19]

Plumpton et al.

[11] 4,314,730

[45] Feb. 9, 1982

[54] MINERAL MINING MACHINE WITH HIGH PRESSURE FLUID NOZZLE AND INTENSIFIER

[75] Inventors: Norman A. Plumpton; Malcolm G. Tomlin, both of Burton-on-Trent, England

[73] Assignee: Coal Industry (Patents) Limited, London, England

[21] Appl. No.: 20,462

[22] Filed: Mar. 14, 1979

[30] Foreign Application Priority Data

Mar. 17, 1978 [GB] United Kingdom ..... 10657/78

[51] Int. Cl.[3] ..... E21C 27/24; E21C 37/06

[52] U.S. Cl. ..... 299/75; 299/17; 299/81; 175/67

[58] Field of Search ..... 299/17, 56, 75, 81; 175/67

[56] References Cited

U.S. PATENT DOCUMENTS

| | | | |
|---|---|---|---|
| 3,375,887 | 4/1968 | Goodwin et al. | 175/67 |
| 3,799,615 | 3/1974 | Taylor et al. | 299/81 X |
| 3,927,723 | 12/1975 | Hall et al. | 175/67 X |
| 3,995,908 | 12/1976 | Razgildeev et al. | 299/17 X |
| 4,025,116 | 5/1977 | Roepke et al. | 299/17 |
| 4,049,318 | 9/1977 | Fruin | 299/17 |

FOREIGN PATENT DOCUMENTS

| | | | |
|---|---|---|---|
| 390265 | 7/1973 | U.S.S.R. | 299/17 |
| 543749 | 3/1977 | U.S.S.R. | 299/81 |

OTHER PUBLICATIONS

"Water-Jets Undergo Full-Scale Tests on Hard Rock Borer", Society of Mining Engr. p. 242, Mar. 1978.

*Primary Examiner*—Ernest R. Purser

*Attorney, Agent, or Firm*—Stevens, Davis, Miller & Mosher

[57] ABSTRACT

The machine comprises a rotatable cutting head and a high pressure water nozzle. The nozzle directs a jet of high pressure (up to 2,100 kg/cm$^2$) water at the rock adjacent the cutting head. The jet of water provides an auxiliary cutting and breaking action, thus easing the load on the head. The water jet also suppresses dust formation.

2 Claims, 9 Drawing Figures

MINERAL MINING MACHINE WITH HIGH PRESSURE FLUID NOZZLE AND INTENSIFIER

This invention relates to a mineral mining machine, and in particular, but not exclusively, to a mineral mining machine for use in driving roadways into rock strata. It is envisaged that the machine of the present invention will be useful for driving roadways alongside coal seams.

Machines used for driving roadways alongside coal seams are usually known as roadheaders, and one type of roadheader and a development thereof are described in detail in the assignee's British Pat. No.'s 987,505 and 1,086,701 respectively.

A typical roadheader comprises a boom, pivotable by an hydraulic ram on a base, a shaft passing through the boom, which shaft is rotatable by an electric motor, and a cutting head located on the free end of the shaft. The cutting head is of generally truncated conical form with its smaller end directed away from the shaft. Alternatively the cutting head is cylindrical. A series of picks is mounted on the end of the head and is used to sump the head into strata to be mined.

A second series of picks is arranged on the side of the head in a scroll pattern, designed to allow each pick to cut a free edge of the rock strata. These picks are used to execavate the main body of the strata. The pick nearest to the larger end of the head contacts the strata first and then in succession picks displaced angularly and laterally from the first pick contact the strata. The picks at the end of the scroll nearest the small end of the head contact the strata last, but are subjected to the most arduous duty and wear out relatively quickly, especially when a conical member is used.

Roadheaders as described above are generally only economically useful for driving into strata whose compressive strength is up to about 82 $MN/m^2$. Even in these rocks the picks wear out quite quickly and need replacing. However, in rocks of greater compressive strength the picks wear out very quickly and would need frequent replacement. Also in strong strata the entire roadheader becomes unstable due to the reactive force exerted on it by the strata. It is usual to create drivages in these stronger strata by blasting.

It has been proposed to assist the action of roadheaders as described above by the use of water jets to cause surface erosion of the mineral or rocks being cut, the purpose of the erosion being to roughen the rock surface so that the cutting picks may better grip on the rock. The water jets do not cut or fracture the rock. Such a system is described in British Pat. No. 1,475,311. However such a system does not overcome the problem of pick wear in cutting hard rock. Moreover the water jet apparatus is exposed on the roadheader boom and can be easily damaged by falling rock. Also the water jet is only able to supply a relatively low pressure water jet.

In coal mining, in particular, it is also known to provide in a cutting head a water jet or spray which provides water to suppress the formation of dust in the mine atmosphere. The water is provided to the sprays at a pressure of about 2 $kg/cm^2$. and has no effect other than dust suppression.

It is an object of the present invention to provide a mineral mining machine which at least partly overcomes the problems associated with presently used roadheaders.

According to a first aspect of the present invention there is provided a mineral mining machine comprising a rotatable cutting head having at least one pick mounted thereon, and at least one high pressure water nozzle for directing a high-pressure rock breaking jet of water at the mineral to be mined adjacent an area being cut by the head. The water jet of the present invention is supplied at a pressure of at least 700 and up to about 2,100 $kg/cm^2$ and primarily provides an auxiliary cutting and breaking action. (In some strata it may be possible to use water pressure of less than 700 $kg/cm^2$, and this, where possible, is within the scope of the invention). Only as a secondary effect is there any dust suppression, although there is likely to be very effective dust suppression. Since the water jet is at such a high pressure there are presented a number of problems not associated with the low pressure dust suppression sprays, particularly in relation to hydraulic connections and seals. The present invention therefore differs from dust suppressing mineral mining machines not only in concept but also in practice.

The mineral mining machine may be a shearer or a roadheader with a cross-axial cutting head. In this latter case the or each nozzle is mounted in or on a boom or other means supporting the head. However, it is envisaged in particular, but not exclusively, that the mineral mining machine will be a roadheader with a co-axial cutting head. Most preferably the roadheader is of the type described in the assignee's British Patent Specification No. 987,505, provided with the necessary hydraulic power supply and conduits. In the case of a roadheader having a co-axial cutting head the or each nozzle may be located in or on the cutting head itself.

The cutting head may be of any conventional shape, for instance cylindrical but is preferably a truncated conical member.

Preferably there is mounted on the head a plurality of picks which are conveniently arranged in a scroll pattern. The head may also have on it a further set of picks used for sumping-in.

Conveniently there is also a plurality of water nozzles, arranged symmetrically around the cutting head. Preferably there are three water nozzles, located close to the picks in the scroll pattern nearest to the smaller end of the head, and directed such that the water jets emerge from the nozzles at an angle of about 45° to the axis of the shaft.

Since the water is normally to be supplied to the nozzles at a pressure from 700 to 2,100 $kg/cm^2$ it is not possible to use conventional flexible piping, and it is necessary to use robust seals and rigid piping for all high pressure conduits.

Any suitable pressurizing means may be used to supply water at high pressure to the sheath nozzle. In a preferred arrangement, oil is pressurized to about 140 $kg/cm^2$ by an electrically driven oil pump. The pressurized oil at 140 $kg/cm^2$ is then fed, using conventional flexible piping to an oil/water intensifier, mounted on the boom of a roadheader. Water is supplied to the intensifier and is therein pressurized to the required high working pressure. The oil pump and intensifier are standard items of equipment, and will need no further explanation to a person skilled in the art. The pressurized water is then fed through a rigid pipe to a rotary seal in the boom which connects the rigid pipe to a conduit in the shaft. The shaft conduit leads to a conduit in the head which supplies the pressurized water to the nozzles. Since these conduits are preferably drilled out of the shaft and head respectively they are sufficiently strong to withstand the high pressure.

According to a second aspect of the invention there is provided a method of mining a mineral stratum, which method includes the steps of rotating a cutting head, causing the cutting head to cut the stratum, and directing a high pressure water jet to impinge upon and to fracture the stratum adjacent an area being cut by the rotating cutting head.

Preferably this method is carried out using a mineral mining machine according to the first aspect of the invention. The water is preferably supplied to the or each nozzle at a pressure of at least 700 and up to about 2,100 kg/cm$^2$ although pressures outside this range will be usable, depending on compressive strength of the stratum.

The shaft and the head may be rotated, by either an hydraulic or electric motor, and the head may be sumped into the strata, for instance by use of a further set of picks, in conventional manner. Preferably the cutting head is pivoted back and forth along a substantially U-shaped path by the boom. As the boom is pivoted the picks cut into the main body of the strata. Simulataneously the water jets shatter the strata forward and to the side of the head, relieving the strata and reducing the cutting load on the picks, especially, in a preferred embodiment, those at the end of the scroll nearest to the smaller end of the head. The jets will also infuse the strata with water and will thereby reduce the amount of dust produced. Since the water jets are always directed into the stratum, there is no danger of any injury occurring to the operator from them.

Using a mineral mining machine according to the present invention increases pick life considerably, enables the machine to cut into strong strata without loss of machine stability and at least assists in suppressing the formation of dust during the cutting operation.

Although it is envisaged that the machine of the present invention will be of use primarily in coal mines it is not limited to such use, and could be of use in many other mining and tunnelling operations.

The invention will now be described, by way of example only, with reference to the accompanying drawings, in which.

Figure 1:
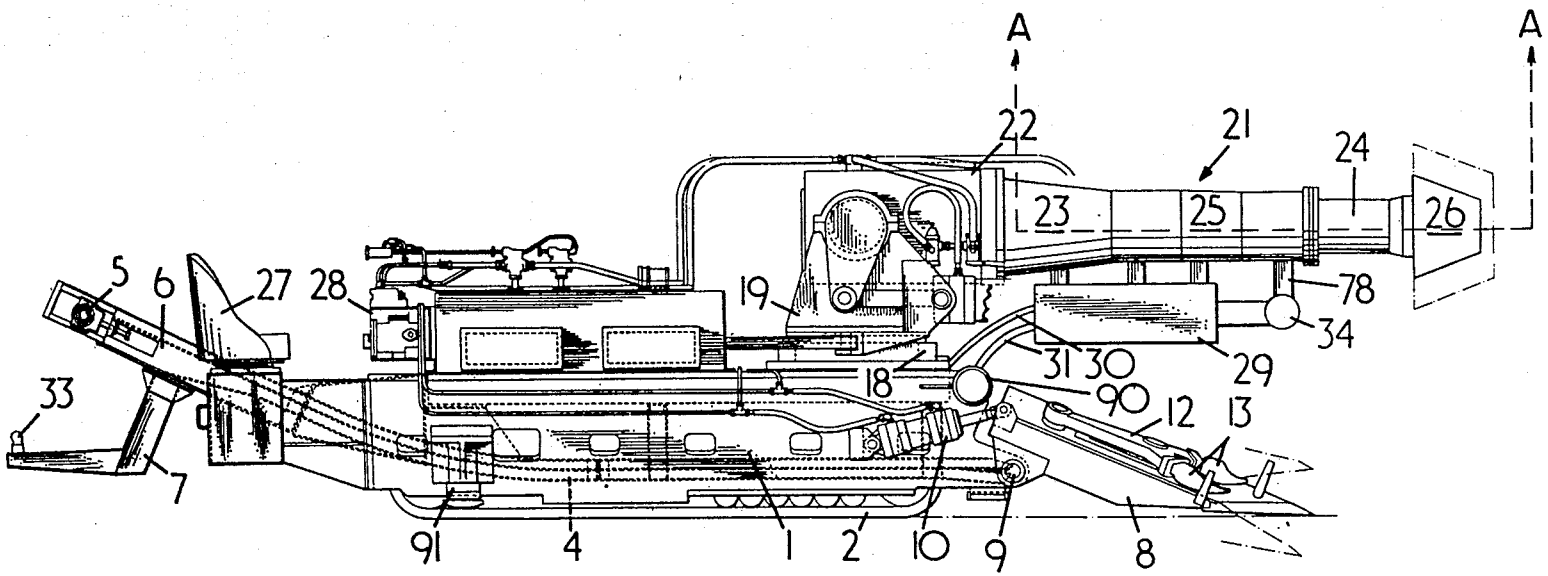
FIG. 1 shows a side view of a mineral mining machine according to the invention with some parts only partly shown, for the sake of clarity.
Figure 3A:
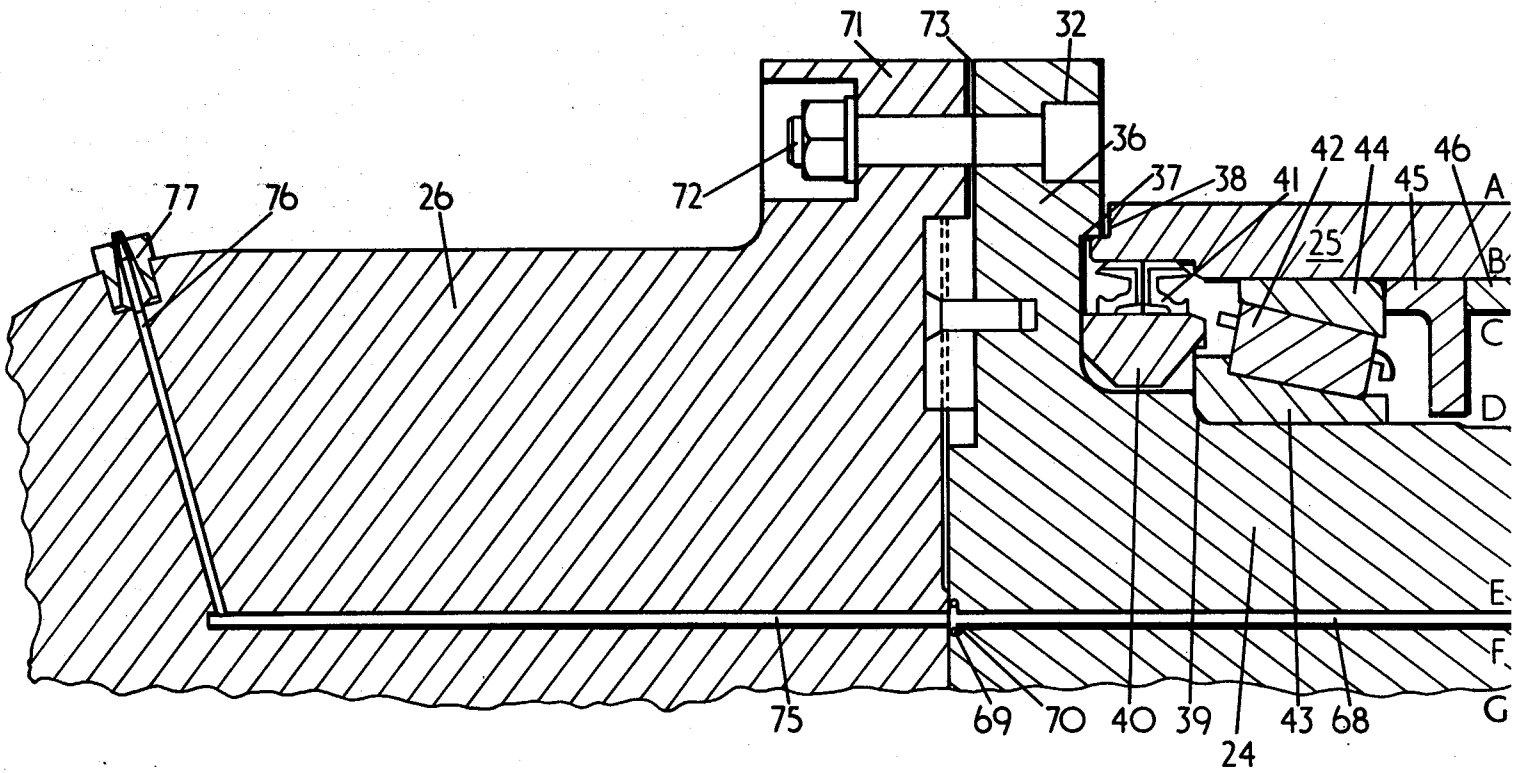
Figure 3B:
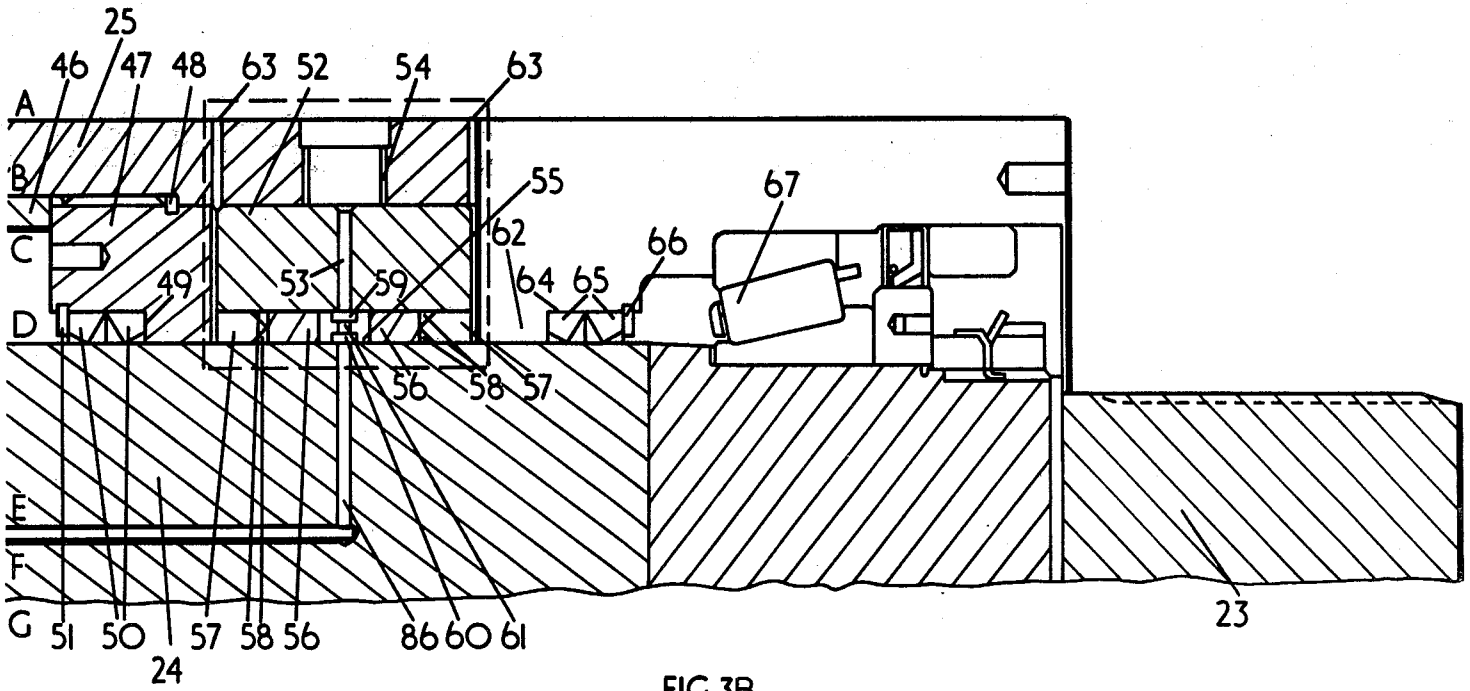
Figure 5:
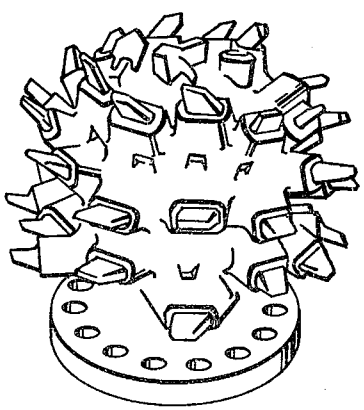
Figure 4:
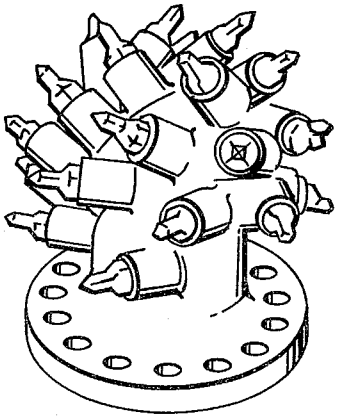
Figure 6:
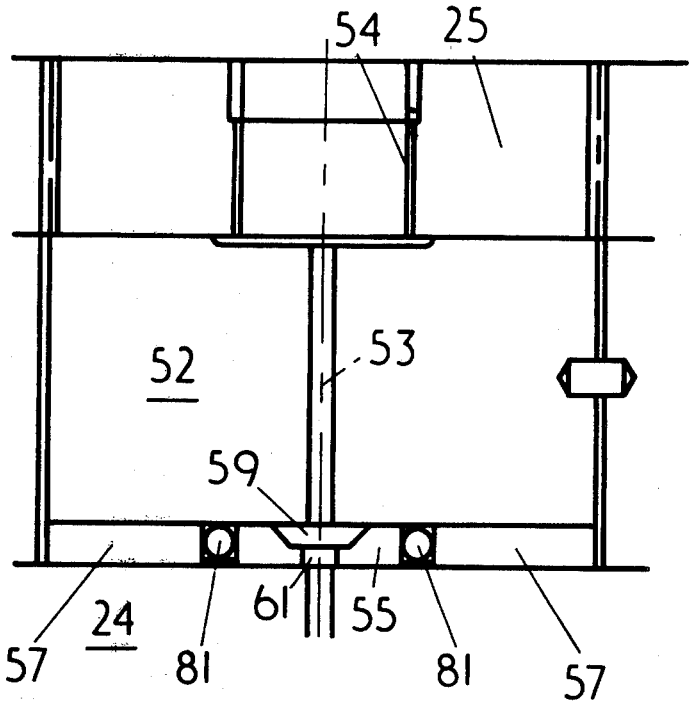
Figure 7:
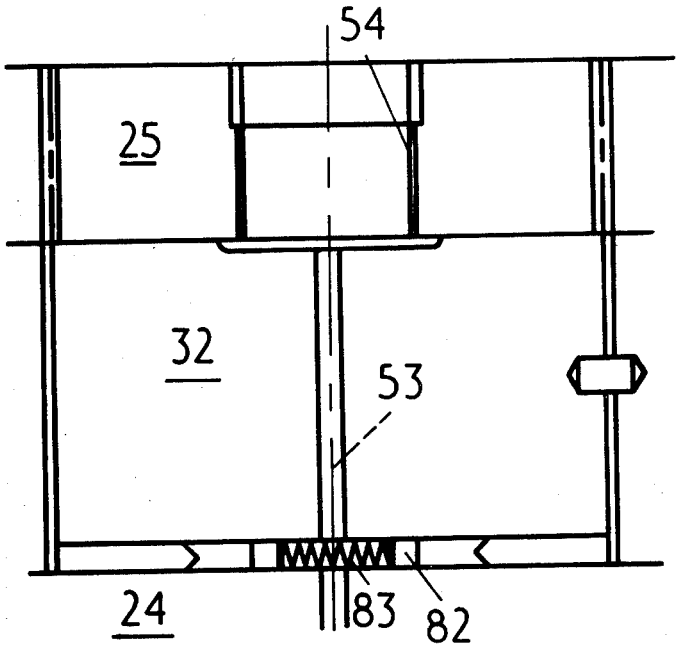

FIGS. 3*a* and 3*b* show, on an enlarged scale a sectional view along the line A-A of FIG. 1 with a part removed for the sake of clarity;

FIG. 4 shows a first cutting head suitable for use on the machine of FIG. 1;

FIG. 5 shows a second cutting head suitable for use on the machine of FIG. 1;

FIG. 6 shows a first alternative arrangement of the area D of FIG. 3;

FIG. 7 shows a second alternative arrangement of the area D of FIG. 3; and

Figure 8:
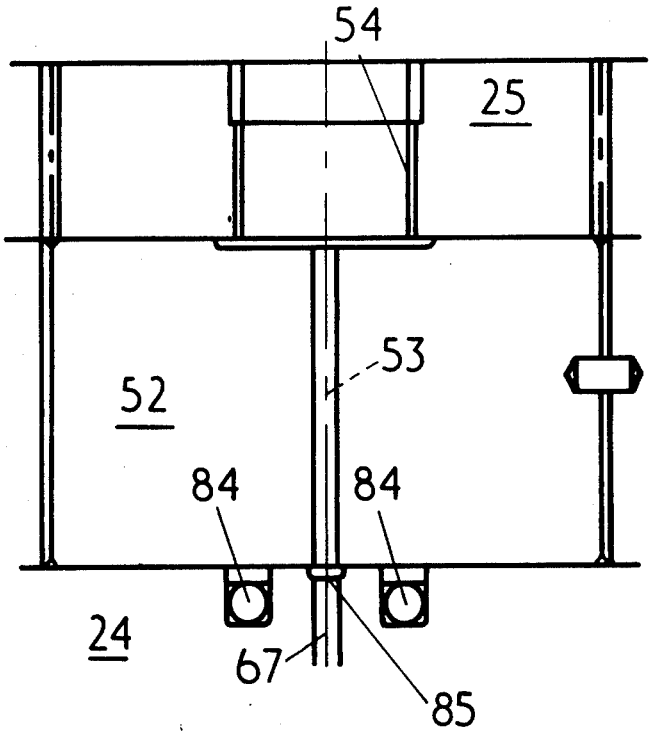

FIG. 8 shows a third alternative arrangement of the area D of FIG. 3.

Figure 2:
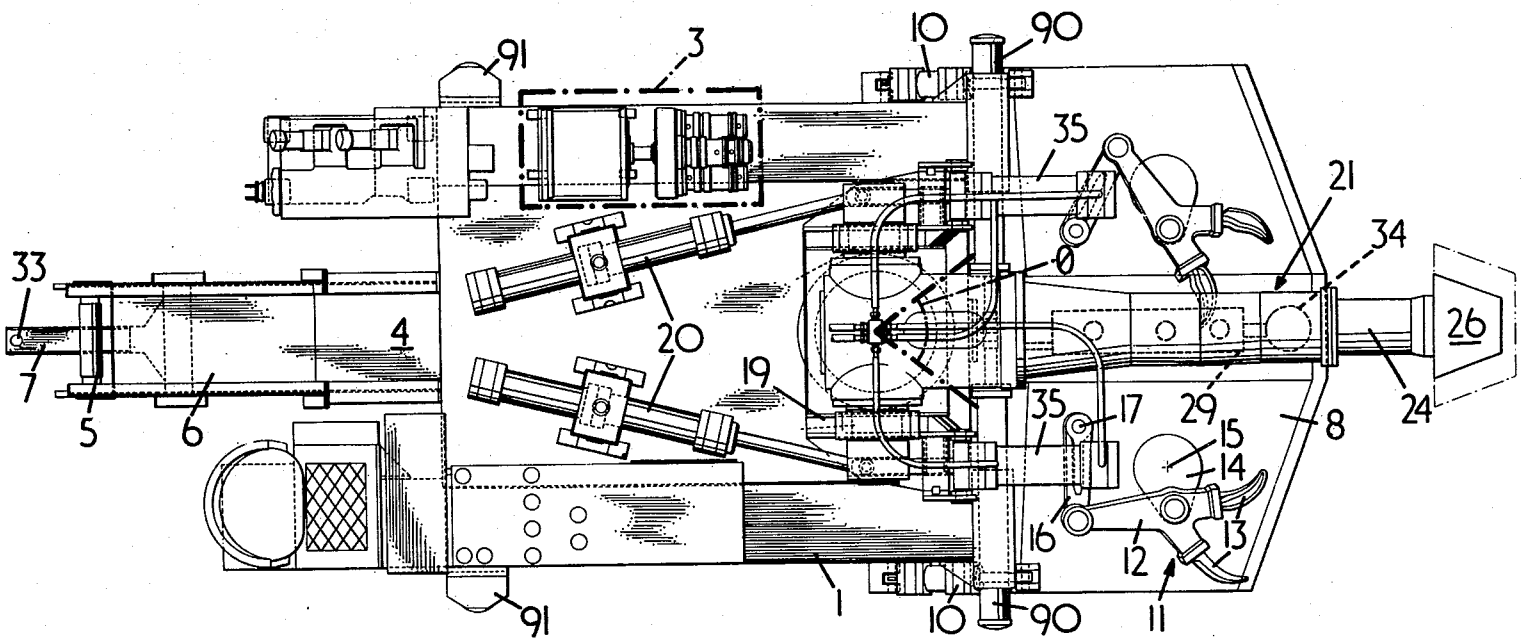
FIG. 2 shows a plan view of the machine of FIG. 1.

Referring now to FIGS. 1 and 2, the mining machine according to the invention is based on a conventional roadheader which has been provided with various parts to bring it into accordance with the present invention. The machine comprises a base 1 which is mounted on a pair of parallel spaced apart crawlers 2, driven by a power pack 3 mounted on the base 1. The power pack 3 receives electrical power and supplies hydraulic power to drive various parts of the machine.

Extending through the base 1 and arranged co-axially with the longitudinal axis thereof is an endless scraper chain conveyor 4 for the removal of debris cut by the machine. The conveyor 4 has a rear return sprocket 5, a forward drive sprocket (not shown) and an elevated rear portion 6 to facilitate discharge of the debris into or onto further conveying means (not shown) for removal from the mine or for packing in the goaf. Depending from the underside of the elevated portion 6 is a cranked bracket 7 for carrying and locating, for example, a conveyor in position below the discharge end of the conveyor 4.

A loading apron 8 is pivotally mounted on the loading end of the base 1 by means of hinges 9, and presents an upper surface which is inclined forwardly and downwardly from the base 1. A pair of hydraulic jacks 10 interconnect the apron 8 and the sides of the base 1 and serve to turn the apron 8 about the hinges 9 for the purpose of steering the machine in the vertical plane. The apron 8 has a central cut-out portion (not shown) to expose the leading portion of the conveyor 4, and is provided with a pair of gathering arms 11 for sweeping debris towards the cut-out portion and hence onto the conveyor 4. Each gathering arm 11 comprises a bifurcated arm 12 terminating in scraper blades 13 and pivoted intermediate its ends to a cam 14 rotating about an axis 15, the arms 11 being pivotally connected at their rears to links 16 which rotate about pivot points 17 when the cams 14 are rotatably driven.

A boom pedestal 18 is mounted on the base 1 and has a turntable 19 rotatably mounted on top thereof. The turntable 19 is rotatable through angle $\theta$ (about 120°) by a pair of hydraulic rams 20. A boom 21 is pivotally mounted on the turntable 19 and is pivotable in a vertical plane (relative to the base 1) by a further pair of hydraulic rams 35 shown only in part in FIG. 2 for clarity.

The boom 21 comprises electric motor 22, gearbox 23, drive shaft 24, shaft sleeve 25 and cutting head 26. The motor 22 and gearbox 23 are conventional parts used in the mining industry and will therefore not be further described. The drive shaft 24, shaft sleeve 25 and cutting head 26 are of novel construction and will be described in more detail below with reference to FIG. 3. Spotlights (not shown), are normally mounted on the boom 21 to facilitate manual operation of the machine.

The machine is controlled by an operative (not shown) who when the machine is in use, sits at the seat 27. A control panel 28 is located on the base 1 in front of the seat 27. The control panel 28 provides means for controlling all aspects of the operation of the machine.

An oil/water pressure intensifier 29, which is of conventional design, is mounted on the gearbox 23 and engine 22 casings. The intensifier 29 is adapted to receive water at mains pressure through flexible pipe 30, and oil at a pressure of about 140 kg/cm$^2$ through flexible pipe 31. The pressurized oil is, in use, supplied as from an electrically driven oil pump (not shown) which is normally towed behind the machine on towing hook 33. In use, the intensifier is adapted to supply from its outlet 34 water at a pressure of about 2,100 kg/cm$^2$.

The construction of the shaft 24, sleeve 25 and head 26 is shown in more detail in FIG. 3, to which reference is now also made. The shaft 24 is at one end coupled to the gearbox 23. At its other end, the shaft 24 has an integral flange 36 which has through it bolt holes 32 and has a step 37. The step 37 is adapted to engage with a complementary step 38 on the shaft sleeve 25. A second step 39 is provided on the main body of the shaft 24, close to the flange 36. A first spacer ring 40 is fixed onto the top of the second step 39, abutting the flange 36, and also abuts a double seal ring 41 fixed onto the sleeve 25. A first roller bearing 42, is located between the sleeve 25 and the shaft 24. One race 43 of the bearing 42 is fixed onto the shaft 24 abutting the second step 39. The other race 44 is fixed onto the sleeve 25 and is held in place by an oil weir 45 and a spacer member 46.

The spacer member 46 abuts a retaining ring 47, which is keyed into place by key 48. The retaining ring 47 abuts both the sleeve 25 and the shaft 24 and has a step 49 cut into the surface abuting the shaft 24. A pair of oil seals 50 are located in the step 49 by circlip 51.

The retaining ring 47 abuts a high pressure cylinder 52 which comprises a cylindrical ring whose outer diameter is the same as the inner diameter of the sleeve 25 but whose inner diameter is greater than the outer diameter of the shaft 24. The cylinder 52 is made from high strength steel, is fixed in position relative to the sleeve 25, and has extending through it radial drilling 53 aligned with an internally threaded high pressure connector 54 located in the sleeve 25.

A seal spacer 55 is located between the cylinder 52 and the shaft 24 by an opposed pair of fluid seals 56 and an opposed pair of back-up rings 57. Each back-up ring 57 has a pointed edge which abuts its respective fluid seal 56. A pair of anti-extusion rings 58 are fitted around the pointed edges of each back-up ring. The seal spacer 55 comprises a cylindrical ring which fits tightly between the cylinder 52 and the shaft 24. The seal spacer 55 has a channel 59 and 60 in each of its cylindrical faces, which channels 59, 60 are interconnected by a series of radial holes 61 spaced evenly around the seal spacer 55. The seal spacer 55 is aligned by the opposed pairs of rings 57 and seals 56 such that the radial drilling 53, in use, is adapted to feed a fluid into the channel 59.

The cylinder 52 and one of the back-up rings 57, at the end remote from the cutting head 26, abut an internal flange 62 of the sleeve 25. However, the cylinder 52 is made such that it is slightly shorter than the distance between the flange 62 and the retaining ring 47. There is therefore a need to impart tolerances into the size of the channel 59 so that it always connects with the drilling 53. Two bores 63 are made in the sleeve 25 such that the centre lines thereof are aligned with the edges of the cylinder 52 when the cylinder 52 is symmetrically placed between the flanges 62 and the retaining ring 47.

The flange 62 has a step 64 in its face away from the cylinder 52, and a pair of seals 65 which abut the shaft 24 are located in the step 64 by a key 66. A further roller bearing 67 is located between the shaft 24 and the sleeve 25 at the gearbox 23 end of the shaft 24. The sleeve 25 at this end is bolted onto the gearbox 23 casing. The sleeve 25 is provided with conventional oil inlets (not shown) through which lubricating oil is introduced.

A conduit, comprising a radial drilling 86 and an axial drilling 68, is formed in the shaft 24. The radial drilling 86 is positioned so that in use it is aligned with the channel 60 in the seal spacer 55. The axial drilling 68 connects the blind end of the radial drilling 86 to the flanged end of the shaft 24. At this end the axial drilling 68 is stepped, and an "O" ring seal 69 is located in the step 70.

The cutting head 26 has a flange 71 complementary to the flange 36 and provided with complementary bolt holes whereby the head 26 is attached to the shaft 24 by bolts 72. A series of radial grooves 73 are provided in the surface of the flange 71 which abuts the flange 36.

The head 26 is shown in FIG. 3 without picks mounted on it for the sake of clarity. However FIGS. 4 and 5 show two arrangements of picks 74 on a cutting head 26 suitable for use in the machine described herein.

An axial drilling 75 in the head 36, aligned, in use, with the axial drilling 68 in the shaft 24, connects to three inclined radial drillings 76 in the head 26. Each radial drilling 76 connects to a water nozzle 77. (Only one each of the radial drillings 76 and nozzles 77 are shown in FIG. 3). The drillings 76 and nozzles 77 are symmetrically disposed around the head 26 and are aligned such that, in use, a jet of fluid (usually water) is directed into the area of strata to be cut by the head 26 to the side of and in front of the head 26. The nozzles 77 are located immediately behind the leading side picks of the head 26. In the present case the nozzles 77 are aligned to give, in use, a jet at an angle of 45° to the axis of the boom 21.

A rigid pressure resistant pipe 78 (not shown in FIG. 3) connects the outlet 34 of the intensifier to the high pressure connector 54 in the shaft sleeve 25.

The machine is used in the following way to drive a roadway into rock stratum or seam (not shown). The head 26 of the machine is sumped into the strata by actuating the motor 22 to rotate the head 26. The crawlers 2 are driven to move the machine towards the stratum, and the head 26 is therefore forced against and into the stratum and proceeds to cut a preliminary hole therein.

When the preliminary hole has been cut, the drive to the crawlers 2 is stopped. In many cases at this point out-rigger jacks 90 and stelling jacks 91 may be set in place to increase the stability of the machine. The need to set these jacks 90, 91 is at least partly obviated by using the machine according to the present invention.

The operator then actuates the electric oil pump which supplies oil at a pressure of about 140 kg/cm$^2$ to the intensifier 29, which also receives water at mains pressure. The water is pressurised to about 2,100 kg/cm$^2$ and is fed out of the intensifier outlet 34, through the rigid pipe 78, high pressure connector 54, radial drillings 53, channel 59 holes 61, channel 60, axial drillings 68 and 75, radial drilling 76, and nozzles 77. The water emerges from the nozzles 77 as a high pressure rock-breaking jet directed into the stratum in front of and to the side of the head 16.

The operator then excavates the main body of the strata by causing the boom 21 to move along substantially U-shaped paths by operation of the turntable rams 20 and the boom pivoting rams 35. As rock is cut from the stratum it falls into the space in front of the machine, and as the machine is moved forward to sump into the next part of the stratum, the debris is pushed onto the conveyor 4 which conveys it to the top of the machine where it falls off the conveyor 4 onto a further conveyor (not shown). The further conveyor is usually towed along behind the machine and is used to transport the debris either out of the tunnel or mine entirely, or to the goaf where it is used to pack the side of the roadway.

The use of the water jets enable the machine to cut a stratum of compressive strength greater than 82

MN/m² with substantial economy of pick life and with increased machine stability.

During its operation water will invevitably leak from the high pressure system, and the bores 63 and grooves 73 are present to allow leaked water to escape. If these were not present the leaking water would exert forces on the sleeve 25 such that it would abut strongly the shaft 24, especially in the area of the complementary steps 37 and 38. It would also distort the rollers bearings 42 and 67, and both these factors would decrease substantially the life of the parts and the efficiency of the mining operation.

The arrangement around the cylinder 52, shown enclosed in chain lines in FIG. 3 and marked by the letter D may be varied to suit availability of parts. FIGS. 6 to 8 to which reference is now also made illustrate three alternative arrangements of the area D.

In FIG. 6 the cylinder 52 is somewhat thicker and the seal spacer 55 is thinner than those in FIG. 3. The second channel of the seal spacer 55 has been dispensed with, the fluid seals 56 have been replaced with PTFE rings 81 and the back-up rings 54 have been slightly altered in shape.

In FIG. 7 the cylinder 52 is again thicker than the one in FIG. 3. The seal spacer 55 in this embodiment comprises a pair of rings 82 held apart by a series of springs 83. The PTFE rings of FIG. 6 have been replaced with PTFE flat seals in this embodiment.

In FIG. 8, the seal spacer 55 has been dispensed with and two pressure seals 84 are located in the shaft 24. A channel 85, made in the shaft 24 around the radial drilling 86 is provided to channel the water from the cylinder 52 to the radial drilling 86.

The various arrangments of this part of the mineral mining machine are designed to be able to withstand the great pressure exerted on them by the water.

We claim:

1. A mineral mining machine comprising:

a rotatable cutting head mounted on a rotatable shaft and having at least one pick mounted thereon and at least one high pressure water nozzle in the head;

boom means mounting said cutting head for swingable movement over a coal face including a rigid shaft and bearings therefore;

intensifier means for producing high pressure water at a pressure from 700 to 2100 Kg/cm², said intensifier means being directly connected to said boom means and movable therewith with a conduit within the rotatable shaft which connects to at least one conduit in the head leading to the nozzle.

2. A mineral mining machine for cutting mineral with a rotatable cutting head and a jet of water at a pressure from of 700 to 2100 Kg/cm² directed at the mineral to be mined, adjacent an area being cut by the head, said machine comprising:

a base having means to move it along the floor of a mine;

a boom mounted for pivotal movement on said base;

a shaft rotatably mounted on said boom and carrying a cutting head at its distal end with a plurality of cutting picks thereon;

means separately supplying water and oil, both at relatively low pressures, to said base;

an oil operated pressure intensifier mounted on said pivotal boom for movement therewith;

rigid conduit means connecting the output of said intensifier directly to a high pressure water passage within said shaft and connected to at least one high pressure water nozzle adjacent or on said head;

high pressure rotary seal means between said shaft and said boom connected to said rigid conduit means;

flexible conduit means between said intensifier and said base, to connect said water and oil at relatively low pressures so that said boom may be easily pivoted in relation to said base while all high pressure connections are carried only by said rigid connections on said boom and moveable therewith.

* * * * *